US005346809A

United States Patent [19]

Takada et al.

[11] Patent Number: 5,346,809

[45] Date of Patent: Sep. 13, 1994

[54] RAPID-ACCESS METHOD OF FORMING A STABILIZED SILVER HALIDE COLOR IMAGE

[75] Inventors: Shun Takada; Satoshi Masumi, both of Odawara, Japan

[73] Assignee: Konica Corporation, Tokyo, Japan

[21] Appl. No.: 990,728

[22] Filed: Dec. 15, 1992

[30] Foreign Application Priority Data

Dec. 26, 1991 [JP] Japan ..... 3-345209

[51] Int. Cl.[5] ..... G03C 7/46; G03C 7/00; G03C 5/18; G03C 1/06

[52] U.S. Cl. ..... 430/393; 430/388; 430/389; 430/399; 430/442; 430/484; 430/607; 430/614; 430/963

[58] Field of Search ..... 430/388, 389, 399, 963, 430/607, 614, 642, 393

[56] References Cited

U.S. PATENT DOCUMENTS

| | | | |
|---|---|---|---|
| 3,775,124 | 11/1973 | Shirasu et al. | 96/56 |
| 4,923,790 | 5/1990 | Kato et al. | 430/614 |
| 5,059,516 | 10/1991 | Sato et al. | 430/607 |
| 5,063,142 | 11/1991 | Ishikawa | 430/963 |
| 5,102,778 | 4/1992 | Nakamura | 430/963 |
| 5,176,987 | 1/1993 | Nakamura et al. | 430/963 |
| 5,217,857 | 6/1993 | Hayashi | 430/556 |

FOREIGN PATENT DOCUMENTS

| | | | |
|---|---|---|---|
| 267491 | 5/1988 | European Pat. Off. . | |
| 289273 | 11/1988 | European Pat. Off. . | |
| 438156 | 7/1991 | European Pat. Off. . | |
| 459334 | 12/1991 | European Pat. Off. . | |
| 0524540 | 1/1993 | European Pat. Off. | 430/388 |
| 2051148 | 2/1990 | Japan | 430/389 |
| 3209243 | 9/1991 | Japan | 430/388 |
| 3209241 | 12/1991 | Japan . | |
| 3209446 | 12/1991 | Japan . | |
| 4291253 | 10/1992 | Japan | 430/388 |

OTHER PUBLICATIONS

Patent Abstracts of Japan, vol. 13, No. 464(p. 947) [3812]; Oct. 20, 1989 JPA-1-180,542; Jul. 18, 1989.

Patent Abstracts of Japan, vol. 14 No. 223 (p. 1046) [4166]; May 11, 1990 JPA-2-51148; Feb. 21, 1990.

*Primary Examiner*—Charles L. Bowers, Jr.
*Assistant Examiner*—J. Pasterczyk
*Attorney, Agent, or Firm*—Jordan B. Bierman

[57] ABSTRACT

A method of photographic color image formation is disclosed. The method gives a color photographic image having high preservability under a condition with a lowered replenishing amount of developer. The method comprises the following steps;

(1) imagewise exposing to light a silver halide color photographic light-sensitive material which comprises a support having thereon a silver halide emulsion layer, (2) developing the exposed light-sensitive material with a color developer, (3) bleach-fixing the developed light-sensitive material with a bleach-fixer, and (4) washing the bleach-fixed light-sensitive material, In the above method, the silver halide emulsion layer contains a specified yellow coupler having a molecular weight of not more than 800 and a specified antifungal agent. The developing step is carried out for a time not more than 25 seconds and developer is replenished with a developer replenisher in a ratio of from 20 ml to 150 ml per square meter of light-sensitive material developed the developer. The total time of the developing step, bleach-fixing step and washing step is not more than 2 minutes.

16 Claims, No Drawings

RAPID-ACCESS METHOD OF FORMING A STABILIZED SILVER HALIDE COLOR IMAGE

FIELD OF THE INVENTION

The present invention relates to a method of forming a color image, particularly to a method of forming a color image by use of a silver halide photographic light-sensitive material, which is suited for low-replenishing rapid processing and improved in color reproducibility and color image preservability.

BACKGROUND OF THE INVENTION

Usually, a silver halide photographic light-sensitive material for color print (hereinafter occasionally referred to as a light-sensitive material) is used to form an image comprising dyes by color development of a light-sensitive material containing yellow, magenta and cyan couplers. In recent years, couplers which form developed dyes with little irregular absorption in the long wavelength region of their spectral absorption characteristics and excellent color reproducibility have been used. As such yellow couplers, those disclosed in Japanese Pat. O.P.I. Pub. Nos. 123027/1988, 209241/1991 and 209466/1991, for example, are employed.

In the aspect of color development of light-sensitive materials, there has been a growing demand for low-replenishing rapid processing in recent years. For example, a method for low-replenishing processing is disclosed in Japanese Pat. O.P.I. Pub. No. 211750/1989 with the object of preventing environmental pollution, and methods for rapid processing are disclosed in Japanese Pat. O.P.I. Pub. Nos. 154052/1991, 154053/1991, 157650/1991, 160439/1991 with the object of raising operational efficiency.

However, when a light-sensitive material using the above yellow coupler of high color reproducibility is subjected to rapid and low-replenishing continuous processing, image preservability after color development tends to be poor, though color reproducibility and low-replenishing rapid processing are successfully attained. Such a poor image preservability features blurs or discolorations of images when color prints each pasted on a mount are laid one upon another and stored for a long period.

SUMMARY OF THE INVENTION

The object of the invention is to provide a silver halide photographic light-sensitive material suitable for rapid and low-replenishing continuous processing and capable of providing satisfactory color reproducibility and color image preservability.

The object of the invention is attained by a method of forming a color image comprising steps of imagewise exposing to light a silver halide color photographic light-sensitive material which comprises a support having thereon a silver halide emulsion layer, developing the exposed light-sensitive material with a color developer, bleach-fixing the developed light-sensitive material with a bleach-fixer, and washing the bleach-fixed light-sensitive material, wherein the silver halide emulsion layer contains a yellow coupler having a molecular weight of not more than 800 and represented by Formula Y-1 and compound represented by Formula I, II, III or IV; the developing step is carried out for a time not more than 25 seconds and developer is replenished with a developer replenisher in a ratio of from 20 ml to 150 ml per square meter of light-sensitive material developed by the developer; and the total time of the developing step, bleach-fixing step and washing step is not more than 2 minutes;

Formula Y-1

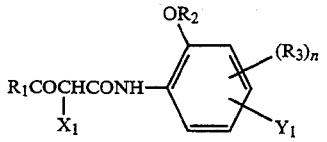

wherein $R_1$ represents an alkyl, cycloalkyl or aryl group; $R_2$ represents an alkyl, cycloalkyl, acyl or aryl group; $R_3$ represents a group capable of being substituted on the benzene ring; n represents 0 or 1; $X_1$ represents a group capable of splitting off upon coupling reaction with an oxidation product of a developing agent; and $Y_1$ represents an organic group, Formula I

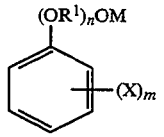

wherein $R^1$ represents a alkylene group having 1 to 5 carbon atoms; M represents a hydrogen atom, an alkali metal atom or an alkyl group; X represents a halogen atom or an alkyl, cycloalkyl, aryl, carboxyl, amino, hydroxyl, sulfo, nitro or alkoxycarbonyl group, m represents an integer of 1 to 5; n represents 0 or 1, Formula II

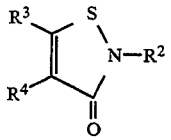

wherein $R^2$ represents a hydrogen atom or an alkyl, cycloalkyl, alkenyl, aralkyl, aryl, alkoxy or —CONHR group (R is a hydrogen atom or an alkyl, aryl, alkylthio, arylthio, alkylsulfonyl or arylsulfonyl group) or a heterocyclic group; $R^3$ and $R^4$ each represent a hydrogen or halogen atom or an alkyl, cycloalkyl, aryl, heterocyclic, cyano, alkylthio, arylthio, alkylsulfoxido, alkylsulfonyl or alkylsulfinyl group; and $R^3$ and $R^4$ may be linked with each other to form a benzene ring which may have a substituent, Formula III

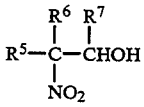

wherein $R^5$ and $R^6$ each represent a hydrogen or halogen atom, a alkyl group having 1 to 5 carbon atoms or a hydroxymethyl group; $R^7$ represents a hydrogen atom or a alkyl group having 1 to 5 carbon atoms, Formula IV

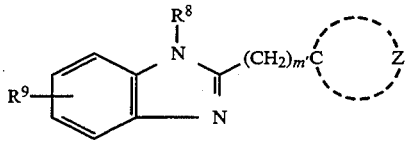

wherein $R^8$ represents a hydrogen atom or an alkyl or aryl group; $R^9$ represents a hydrogen or halogen atom or an alkyl, aryl, nitro, carboxyl, sulfo, sulfamoyl, hydroxyl, alkoxy or thiazolyl group; Z represents a group of atoms which form a thiazole ring; m' represents 0 or 1.

DETAILED DESCRIPTION OF THE INVENTION

In Formula Y-1, the alkyl group represented by $R_1$ is, for example, a methyl, ethyl, i-propyl, t-butyl or dodecyl group. These alkyl groups represented by $R_1$ include those having a substituent such as a halogen atom or an aryl, alkoxy, aryloxy, alkylsulfonyl, acylamino and hydroxyl group.

The cycloalkyl group represented by $R_1$ is, for example, an organic hydrocarbon residue formed by condensation of two or more cycloalkyl groups, e.g., an adamantyl group, besides a cyclopropyl or cyclohexyl group. The cycloalkyl group represented by $R_1$ includes those having such a substituent as those exemplified for the alkyl group represented by $R_1$.

The aryl group represented by $R_1$ is, for example, a phenyl group and includes those having a substituent. Examples of such substituents include those exemplified as substituents for the alkyl group represented by $R_1$. Among them, a preferred example of $R_1$ is a branched alkyl group.

The alkyl, cycloalkyl and aryl group each represented by $R_2$ are the same groups as those represented by $R_1$ and may have a substituent. Examples of substituents include those exemplified for $R_1$. Examples of the acyl group so-represented include the groups of acetyl, propionyl, butylyl, hexanoyl and benzoyl, each of which may have a substituent. Favorable examples of $R_2$ are an alkyl and aryl group; of them, an alkyl group is preferred, a lower alkyl group having 5 or less carbon atoms is particularly preferred.

The group capable of being substituted on a benzene ring which is represented by $R_3$ includes, for example, a halogen atom, e.g., chlorine, an alkyl group, e.g., ethyl, i-propyl, t-butyl, an alkoxy group, e.g., methoxy, an aryloxy group, e.g., phenyloxy, an acyloxy group, e.g., acetyloxy, benzoyloxy, an acylamino group, e.g., acetamido, benzamido, a carbamoyl group, e.g., N-methylcarbamoyl, N-phenylcarbamoyl, an alkylsulfonamido group, e.g., ethylsulfonamido, an arylsulfonamido group, e.g., phenylsulfonamido, a sulfamoyl group, e.g., N-propylsulfamoyl, N-phenylsulfamoyl and an imido group, e.g., succinimido, glutarimido.

The organic group represented by $Y_1$ is preferably a group represented by the following formula Y-2.

Formula Y-2

$$-(J)_p-R_4$$

In the formula, $R_4$ is an organic group containing one linking group having a carbonyl or sulfonyl unit, p is 0 or 1.

Examples of the group having a carbonyl unit include an ester, amido, carbamoyl, ureido and urethane group; examples of the group having a sulfonyl unit include a sulfonyl, sulfonylamino, sulfamoyl and aminosulfonylamino group.

J represents a $-N(R_5)CO-$ or $-CON(R_5)-$ group, where $R_5$ is a hydrogen atom, an alkyl, aryl or heterocyclic group.

The alkyl group represented by $R_5$ includes a methyl, ethyl, i-propyl, t-butyl and dodecyl group; the aryl group so-represented includes a phenyl and naphthyl group; and the heterocyclic group so-represented includes a pyridyl group.

These groups represented by $R_5$ may have a substituent. Such substituents are not particularly limited; but, typical examples include a halogen atom, e.g., chlorine, an alkyl group, e.g., ethyl, t-butyl, an aryl group, e.g., phenyl, p-methoxyphenyl, naphthyl, an alkoxy group, e.g., ethoxy, benzyloxy, an aryloxy group, e.g., phenoxy, an alkylthio group, e.g., ethylthio, an arylthio group, phenylthio, an alkylsulfonyl group, e.g., β-hydroxyethylsulfonyl, an arylsulfonyl group, e.g., phenylsulfonyl, an acylamino group, e.g., an alkylcarbonylamino group such as acetamido and an arylcarbonylamino group such as benzamido, a carbamoyl group, e.g., an alkylcarbamoyl group such as N-methylcarbamoyl and an aryl carbamoyl group such as N-phenylcarbamoyl, an acyl group, e.g., an alkylcarbonyl group such as acetyl, and an arylcarbonyl group such as benzoyl, a sulfonamido group, e.g., an alkylsulfonamido group such as methylsulfonamido and arylsulfonamido group such as phenylsulfonamido, a sulfamoyl group, e.g., an alkylsulfamoyl group such as N-methylsulfamoyl, and an arylsulfamoyl group such as N-phenylsulfamoyl, a hydroxyl group and a cyano group.

The group represented by $X_1$ and capable of splitting off upon coupling with an oxidation product of a developing agent includes, for example, those represented by the following formula Y-3 or Y-4; of them, those represented by Formula Y-4 are particularly preferred.

Formula Y-3

$$-OR_6$$

In the formula, $R_6$ represents an aryl or heterocyclic group, they may have a substituent.

Formula Y-4

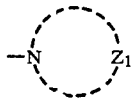

In the formula, $Z_1$ represents a nonmetal atomic group necessary to form a 5- to 6-membered ring jointly with the nitrogen atom; examples of such a non-metal atomic group include a substituted or unsubstituted methylene, methine, $=C=O$, $-NR_A$, where $R_A$ is the same as $R_5$, $-N=$, $-O-$, $-S-$ and $-SO_2-$group.

The yellow coupler represented by Formula Y-1 may form a bis-compound by being linked with each other at a position of $R_1$, $R_3$ or $Y_1$.

Among the yellow couplers of the invention, those represented by the following formula $Y_{-5}$ are particularly preferred.

Formula Y-5

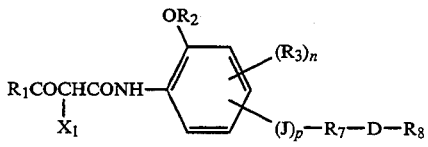

In Formula Y-5, $R_1$, $R_2$, $R_3$, n and $X_1$ are the same as $R_1$, $R_2$, $R_3$, n and $X_1$ in Formula Y-1, J, p are the same as J, p in Formula Y-2, and each exemplified equally; $R_7$ represents an alkylene, arylene, alkylenearylene, arylenealkylene or —A—$E_1$—B— group, where A and B each represent an alkylene, arylene, alkylenearylene or arylenealkylene group; $E_1$ represents a divalent linking group; $R_8$ represents an alkyl, cycloalkyl, aryl or heterocyclic group; D represents a linking group having a carbonyl or sulfonyl unit.

The alkylene group represented by $R_7$, A or B includes straight-chain and branched-chain groups such as a methylene, ethylene, trimethylene, butylene, hexylene, methylmethylene, ethylethylene, 1-methylethylene, 1-methyl-2-ethylethylene, 2-decylethylene and 3-hexylpropylene group. These alkylene groups may have a substituent, e.g., an aryl group; examples thereof include a 1-benzylethylene, 2-phenylethylene and 3-naphthylpropylene group.

The arylene group so represented includes, for example, a phenylene and naphthylene group including that having a substituent.

The alkylenearylene group includes, for example, a methylenephenylene group; the arylenealkylene group include, for example, a phenylenemethylene group; and each of them may have a substituent.

Examples of the bivalent linking group represented by $V_1$ include a —O— and —S— group.

Among the alkylene, arylene, alkylenearylene, arylenealkylene and —A—$E_1$—B— group represented by $R_7$, the alkylene group is particularly preferred.

The alkyl group represented by $R_8$ includes straight-chain and branched ones such as an ethyl, butyl, hexyl, octyl, 2-ethylhexyl, dodecyl, hexadecyl, 2-hexadecyl and octadecyl group. The cycloalkyl group so represented includes, for example, a cyclohexyl group. The aryl group represents, for example, a phenyl and naphthyl group. The heterocyclic group include, for example, a pyridyl group.

Those alkyl, cycloalkyl, aryl and heterocyclic groups which are represented by $R_8$ may further have a substituent. The substituent is not particularly limited; examples thereof are those exemplified as substituents of the above $R_5$.

D represents a linking group having a carbonyl or sulfonyl unit. Preferred examples of such a linking group are those represented by the following family Y-6; among them, linking groups denoted by (6) to (9) are particularly preferred.

Family Y- 6

(1) —COO—, (2) —N(R)CO—, (3) —CON(R)—, (4) —N(R)CON(R')—, (5) —N(R)COO—, (6) —$SO_2$—, (7) —N(R)$SO_2$—, (8) —$SO_2$N(R)— (9) —N(R)$SO_2$N(R')—

In these formulas, R and R' each represent a hydrogen atom, an alkyl, aryl or heterocyclic group; examples of them are the same as those defined for the above $R_5$. Each of these groups may have a substituent such as those exemplified for $R_5$. The preferred one for R or R' is a hydrogen atom.

The yellow coupler represented by Formula Y-1 of the invention is used in an amount of preferably $1\times10^{-3}$ to 1 mole, especially $1\times10^{-2}$ to $8\times10^{-1}$ mole per mole of silver halide.

The yellow coupler represented by Formula Y-1 has a molecular weight preferably not more than 750, especially not more than 700.

Typical examples of the yellow coupler represented by Formula Y-1 (hereinafter referred to as the yellow coupler of the invention) are shown below.

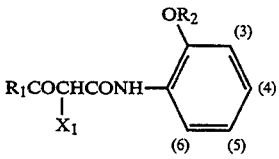

| No. | $R_1$ | $R_2$ | $X_1$ | 3-position to 6-position |
|---|---|---|---|---|
| Y-1 | (t)$C_4H_9$— | —$CH_3$ | 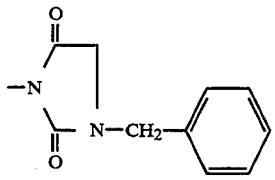 | 5-NHCO$(CH_2)_3$O— 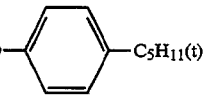 —$C_5H_{11}$(t) |
| Y-2 | (t)$C_4H_9$— | —$CH_3$ | 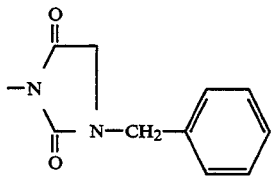 | 5-NHCO$C_{15}H_{31}$ |

-continued
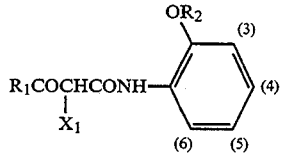
| No. | $R_1$ | $R_2$ | $X_1$ | 3-position to 6-position |
|---|---|---|---|---|
| Y-3 | (t)$C_4H_9$— | —$CH_3$ | 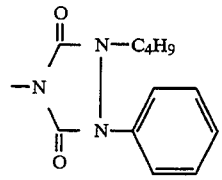 | 5-NHCO$CH(CH_3)CH_2SO_2C_{12}H_{25}$ |
| Y-4 | (t)$C_4H_9$— | —$CH_3$ | 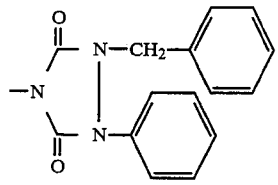 | 5-$NHCOC_{12}H_{25}$ |
| Y-5 | (t)$C_4H_9$— | —$CH_3$ | 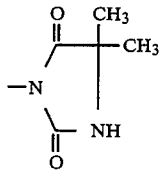 | 5-$NHCOC_{17}H_{35}$ |
| Y-6 | (t)$C_4H_9$— | —$CH_3$ | 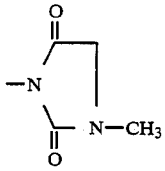 | 5-NHCO$CH(CH_3)CH_2SO_2C_{12}H_{25}$ |
| Y-7 | (t)$C_4H_9$— | —$CH_3$ | 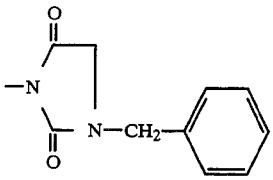 | 5-$SO_2NHC_{15}H_{31}$ |
| Y-8 | (t)$C_4H_9$— | —$C_3H_7$(i) | 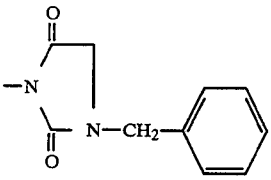 | 5-$NHSO_2C_{16}H_{33}$ |
| Y-9 | (t)$C_4H_9$— | —$CH_3$ | 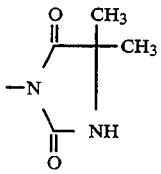 | 5-CONH— 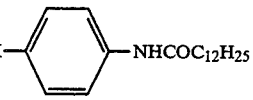 —$NHCOC_{12}H_{25}$ |
| Y-10 | (t)$C_4H_9$— | —$C_8H_{17}$ | 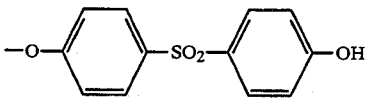 | 5-CONH$CH(CH_3)CH_2SO_2C_2H_5$ |

-continued
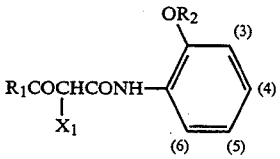
| No. | $R_1$ | $R_2$ | $X_1$ | 3-position to 6-position |
|---|---|---|---|---|
| Y-11 | (t)$C_4H_9$— | —$CH_3$ | 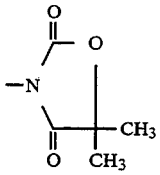 | 5-$COOC_{14}H_{29}$ |
| Y-12 | 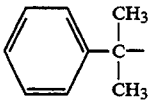 | —$C_{12}H_{25}$ | 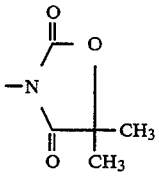 | 5-$NHCOC_4H_9$ |
| Y-13 | (t)$C_5H_{11}$— | —$CH_3$ | 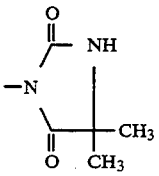 | 5-$NHCOC_{14}H_{29}$ |
| Y-14 | (t)$C_4H_9$— | —$CH_3$ | 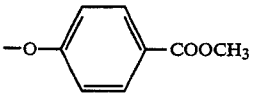 | 5-$COOC_{18}H_{35}$ |
| Y-15 | (t)$C_4H_9$— | —$CH_3$ | 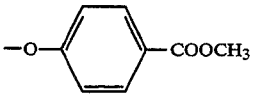 | 5-$NHCOCH(CH_3)CH_2SO_2C_{12}H_{25}$ |
| Y-16 | (t)$C_4H_9$— | —$CH_3$ | 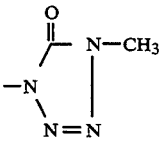 | 5-$NHCOCH_2CH_2COOC_8H_{17}$ |
| Y-17 | 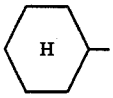 | —$CH_3$ | 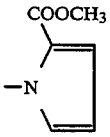 | 5-$NHCOCH(CH_3)NHCOCH_2$— 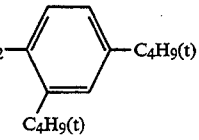 |
| Y-18 | 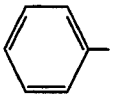 | —$CH_3$ | 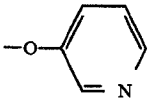 | 5-$NHCOCH_2O$— 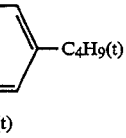 |
| Y-19 | (t)$C_4H_9$— | —$C_{16}H_{33}$ | 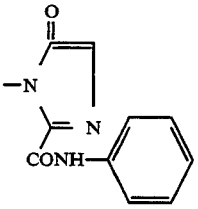 | 5-$SO_2NHCOC_2H_5$ |

-continued

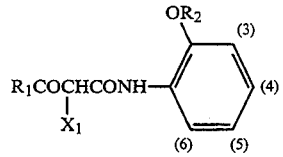

| No. | $R_1$ | $R_2$ | $X_1$ | 3-position to 6-position |
|---|---|---|---|---|
| Y-20 | (t)$C_4H_9$— | —$CH_3$ | 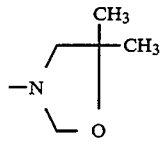 | 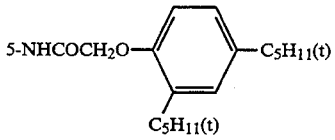 |

In Formula I, the alkylene group having 1 to 5 carbon atoms represented by $R^1$ includes a methylene, ethylene, propylene, butylene and pentylene group. The alkali metal represented by M includes sodium and potassium. The halogen atom represented by X includes chlorine, bromine and iodine. The alkyl group represented by M or X includes a straight-chain or branched alkyl group having 1 to 8 carbon atoms. The cycloalkyl group represented by X is preferably a cycloalkyl group having 4 to 8 carbon atoms; the aryl group includes a phenyl and naphthyl group. The number of carbon atoms contained in the alkoxycarbonyl group is preferably 1 to 5.

Further, each of the above groups may have a substituent such as an alkyl group of 1 to 4 carbon atoms, a halogen atom or a hydroxyl, sulfo, nitro, cyano, carboxyl or phenyl group.

In Formula II, the alkyl or alkenyl group represented by $R^2$ has preferably 1 to 36 and especially 1 to 18 carbon atoms. The number of carbon atoms in the cycloalkyl group is preferably 3 to 12, especially 3 to 6. These alkyl, alkenyl, cycloalkyl, aralkyl, aryl and heterocyclic groups may have a substituent; such a substituent may be selected from halogen atoms and nitro, cyano, thiocyano, aryl, alkoxy, aryloxy, carboxyl, sulfoxy, alkylcarbonyl, alkoxycarbonyl, aryloxycarbonyl, sulfo, acyloxy, sulfamoyl, carbamoyl, acylamino, diacylamino, ureido, thioureido, urethane, thiourethane, sulfonamido, arylsulfonyloxy, alkylsulfonyloxy, arylsulfonyl, alkylsulfonyl, arylthio, aralkylthio, alkylsulfinyl, arylsulfinyl, alkylamino, dialkylamino, anilino, hydroxyl, mercapto and heterocyclic groups.

The number of carbon atoms contained in the alkyl group represented by $R^3$ or $R^4$ is preferably 1 to 18, especially 1 to 9; the number of carbon atoms in the cycloalkyl group is preferably 3 to 12, especially 3 to 6. These alkyl, cycloalkyl and aryl groups may have a substituent such as a halogen atom or a nitro, sulfo, aryl or hydroxyl group. When $R^3$ and $R^4$ form a benzene ring in conjunction, examples of the substituent on this benzene ring include a halogen atom and an alkyl, alkoxy, cyano and nitro group.

In Formula III, the alkyl group having 1 to 5 carbon atoms represented by $R^5$, $R^6$ or $R^7$ may have a substituent.

In Formula IV, $R^8$ is preferably a hydrogen atom or an alkyl group having 1 to 3 carbon atoms; $R^9$ is preferably a nitro, sulfo or hydroxyl group or a halogen atom; m' is preferably 1.

Some of the compounds represented by Formula I, II, III or IV are known as an antiseptic for a hydrophilic colloid used in a light-sensitive material. For example, some of the compounds of Formula I are disclosed in Japanese Pat. O.P.I. Pub. Nos. 22857/1984, 257747/1988, some of the compounds of Formula II in Japanese Pat. O.P.I. Pub. Nos. 27424/1979, 181929/1984, 142548/1984, 166343/1983, 226343/1984, some of the compounds of Formula III in Japanese Pat. O.P.I. Pub. Nos. 119547/1985, 231936/1987, and some of the compounds of Formula IV in Japanese Pat. O.P.I. Pub. Nos. 274944/1988, 263938/1985. However, none of the above literature describes the color image preservability of a light-sensitive material subjected to rapid and low-replenishing continuous processing.

Typical examples of the compound represented by the above Formula I, II, III or IV (hereinafter referred to as the compound of the invention) are shown below.

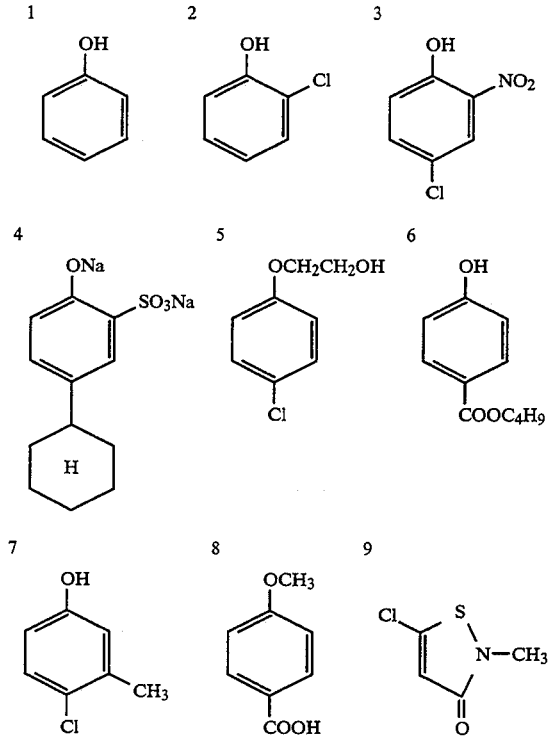

-continued
10
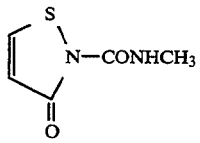
11
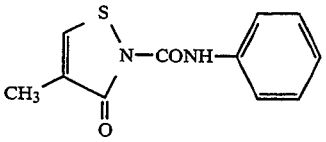
12
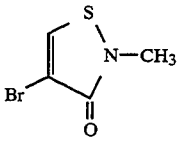
13
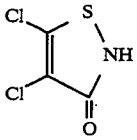
14
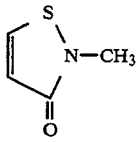
15
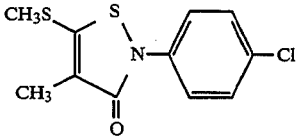
16
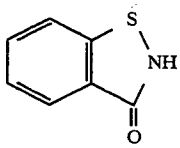
17
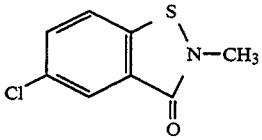
18
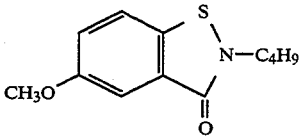
19
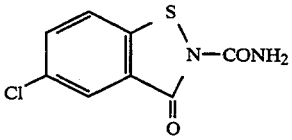
20
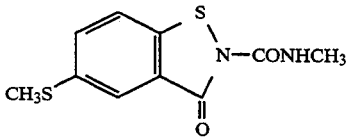
21
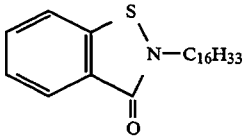
22
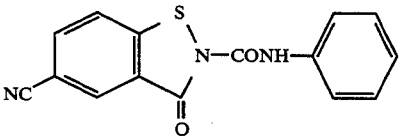
-continued
23
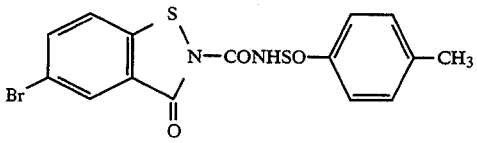
24
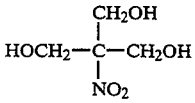
25
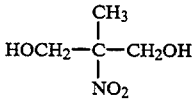
26
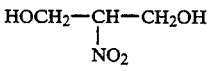
27
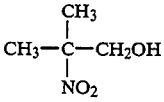
28
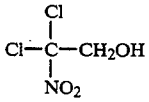
29
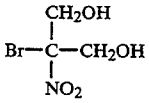
30
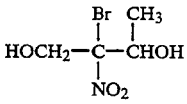
31
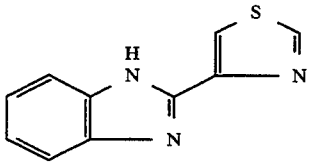
32
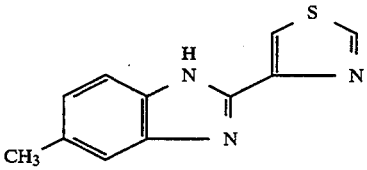
33
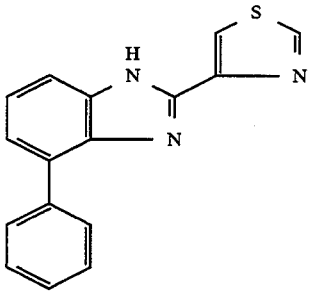
34
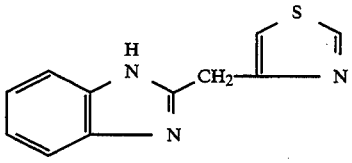

-continued

35

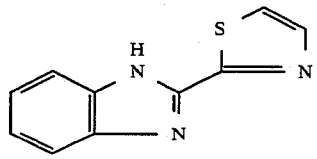

36

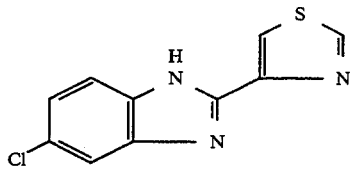

37

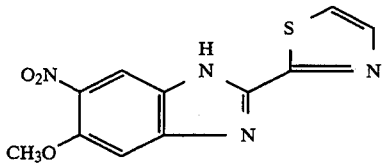

In embodying the invention, one or more of these compounds can be selected from those exemplified above. They are well known in the art and placed on the market by the companies; I.C.I. Japan, Dainippon Ink & Chemicals, Rohm & Haas Japan and San-ai Sekiyu.

The addition amount of these compounds is not limitative, but preferably within the range of $1\times10^{-4}$ to $1\times10^{-2}$ g/m$^2$. In the present invention, these compounds are contained in the silver halide emulsion layer. The compound may be further contain in a non-emulsion layer. The addition method is not particularly limited. Among the above compounds represented by Formulas I to IV, ones represented by Formula II are preferable.

The silver halide grains used in the invention may have any crystal form. One preferred form is a cube having (100) faces as crystal face.

The silver halide grains used in the invention may comprise grains of the same form or a mixture of grains different in crystal forms.

The size of grains used in the invention is not limitative; but, in view of photographic properties such as rapid processability and sensitivity, it is preferably 0.1 to 1.2 μm, especially 0.2 to 1.0 μm.

The distribution of sizes of silver halide grains used in the invention may be either polydispersed or monodispersed. Preferred are monodispersed silver halide grains having a coefficient of variation not more than 0.22, especially not more than 0.15. The coefficient of variation used here is a coefficient indicating the extent of a grain size distribution and defined by the following equation:

Coefficient of Variation $=S/R$, where S is a standard deviation of a grain size distribution and R is an average grain size.

Here, grain size means a diameter for a spherical silver halide grain, and a diameter of a circular image converted equally in area from a projected image of a grain for a grain having a shape other than a cube or a sphere.

In the preparation of a silver halide emulsion, various apparatus and processes known in the art can be used.

Silver halide emulsions used in the invention may be prepared by any of the acid method, the neutral method and the ammoniacal method. The grains may be those which are grown in one step or those which are grown from seed grains. The process for preparing seed grains and that for growing seed grains may be the same or different.

The reaction between a soluble silver salt and a soluble halide may be carried out by any of the single-jet method, the reverse mixing method, the double-Jet method and combinations thereof, but the double-jet method is preferred. The pAg controlled double-jet method disclosed in Japanese Pat. O.P.I. Pub. No. 48521 can be used as a modification of the double-jet method.

Further, there may be employed the apparatus disclosed in Japanese Pat. O.P.I. Pub. Nos. 92523/1982, 92524/1982, with which an aqueous solution of a water-soluble silver salt and that of a water-soluble halide are fed through a feeding unit arranged in a reaction liquor; the apparatus disclosed in German Offenlegunshrift 2921164, with which an aqueous solution of a water-soluble silver salt and that of a water-soluble halide are fed at continuously varied concentrations; and the apparatus disclosed in Japanese Pat. Exam. Pub. No. 501775/1981, with which silver halide grains are grown while distances among neighboring grains are kept constant by taking the reaction liquor out of the reaction vessel and concentrating it by ultrafiltration.

In addition, a silver halide solvent such as thioether may be used if necessary. Moreover, there may also be added a mercapto-group-containing compound, a nitrogen-containing heterocyclic compound or a compound such as a sensitizing dye during silver halide grain formation or after the formation of grains.

There may be employed a conventional antifoggant and a stabilizer in the silver halide emulsion used in the invention, for the purposes of preventing fog in the manufacturing process of a silver halide photographic light-sensitive material, minimizing the fluctuation of performance during storage and preventing fog in the developing process. Examples of the compound used for these purposes include the compound represented by Formula II shown in the lower column of page 7 of the specification of Japanese Pat. O.P.I. Pub. No. 146036/1990; typical examples of the compound include those denoted by (IIa-1) to (IIa-8) and (IIb-1) to (IIb-7) on page 8 of the above specification and 1-(3-methoxyphenyl)-5-mercaptotetrazole as well. These compounds are added, according to the purpose of the addition, in the preparation process of silver halide grains, in or after the chemical sensitizing process or in the preparation process of a coating solution. When chemical sensitization is carried out in the presence of these compounds, the addition amount thereof is preferably $1\times10^{-5}$ to $5\times10^{-4}$ per mole of silver halide. When these are added after completion of chemical sensitization, the addition amount is preferably $1\times10^{-6}$ to $1\times10^{-2}$, especially $1\times10^{-5}$ to $5\times10^{-3}$ per mole of silver halide. When the addition is made to a silver halide emulsion layer in the preparation process of a coating solution, the amount is preferably $1\times10^{-6}$ to $1\times10^{-1}$, especially $1\times10^{-5}$ to $1\times10^{-2}$ per mole of silver halide. When the addition is made to a layer other than the silver halide emulsion layer, the amount is preferably $1\times10^{-9}$ to $1\times10^{-3}$ mole per square meter of coated layer.

When used as a color light-sensitive material, the light-sensitive material of the invention has a silver halide emulsion layer which is chemically sensitized to a specific wavelength region of 400 to 900 nm by combination of a yellow coupler, a magenta coupler and a cyan coupler. Such a silver halide emulsion layer contains one or a plurality of spectral sensitizing dyes in combination.

As spectral sensitizing dyes, any of the conventional ones can be used. But, as blue-sensitive sensitizing dyes, it is preferable to use, singly or in combination, those denoted by BS-1 to BS-8 described in Japanese Pat. O.P.I. Pub. No. 251840/1991. As green-sensitive sensitizing dyes, those denoted by GS-1 to GS-5 in same publication are preferably used. As red-sensitive sensitizing dyes, those denoted by RS-1 to RS-8 on pages 111–112 of the same publication are preferred.

For the light-sensitive material of the invention, a dye having an absorption in various wavelength regions can be used for preventing irradiation and halation. Any of the conventional compounds for this purpose can be used; but, the dyes denoted by AI-1 to AI-11 described in Japanese Pat. O.P.I. Pub. No. 251840/1991 are preferred as dyes having an absorption in the visible region; as infrared absorbing dyes, the compounds represented by Formula I, II or III described in the lower left column of page 2 of Japanese Pat. O.P.I. Pub. No. 280750/1989 have favorable spectral characteristics and, moreover, produce no adverse effects on the photographic properties of a silver halide photographic emulsion nor stains attributable to residual colors. Preferred examples of the compound include exemplified compounds (1) to (45) shown from the lower left column of page 3 to the lower left column of page 5 of the same publication.

As couplers used in the light-sensitive material of the invention, there may be used any compound which forms a coupling product having a spectral absorption maximum wavelength in a wavelength region longer than 340 nm, upon coupling with an oxidation product of a color developing agent. Besides the yellow couplers of the invention, examples of usable couplers include magenta couplers having a spectral absorption maximum wavelength in a wavelength region of 500 to 600 nm and cyan couplers having a spectral absorption maximum wavelength in a wavelength region of 600 to 750 nm.

Magenta couplers preferred in the invention include those represented by Formula M-I or M-II described in Japanese Pat. O.P.I. Pub. No. 114154/1992. Typical examples thereof are those denoted by MC-1 to MC-11 in the same publication; among them, those denoted by MC-8 to MC-11 are particularly preferred for their excellent reproducability in colors from blue, purple to red and high capability of describing details of an image.

Cyan couplers preferred in the invention include those represented by Formula C-I or C-II described in Japanese Pat. O.P.I. Pub. No. 114154/1992; typical examples thereof are those denoted by CC-1 to CC-11 in the same publication.

When a coupler is added to a silver halide emulsion by the oil-in-water type emulsifying method, the coupler is usually dissolved in a water-insoluble high boiling solvent having a boiling point higher than 150° C., or jointly using a low boiling and/or water-soluble organic solvent if necessary, and the solution is then dispersed in a hydrophilic binder, such as an aqueous solution of gelatin, with the aid of a surfactant. As emulsifying and dispersing means, there can be used a stirrer, a homogenizer, a colloid mill, a flow-jet mixer and a supersonic disperser. A process to remove the low boiling solvent may be provided after or concurrently with the dispersing. As high boiling solvents used to dissolve and disperse a coupler, phthalates such as dioctyl phthalate and phosphates such as tricresyl phosphate are favorably employed.

As an alternative to the use of a high boiling organic solvent, a coupler dispersion may be prepared by dissolving, if necessary, a mixture of a coupler and a polymeric compound insoluble in water and soluble in organic solvents, in a low boiling and/or water-soluble organic solvent, and dispersing the mixture or the resulting solution in a hydrophilic binder, such as an aqueous solution of gelatin, with the aid of a surfactant by use of various emulsifying and dispersing means. In this case, poly(N-t-butylacrylamide) and its analogues can be used as a polymeric compound insoluble in water and soluble in organic solvents.

In the invention, compounds such as that denoted by d-11 on page 33 of Japanese Pat. Appl. No. 234208/1990 and that denoted by A'-1 on page 35 of the same specification can be used for the purpose of shifting the absorption wavelength of a developed dye. Besides these compounds, a fluorescent-dye-releasing compound disclosed in U.S. Pat. No. 4,774,187 can also be used.

The coating weight of a coupler is not particularly limited as long as it provides an adequate color density, but it is preferably $1\times10^{-3}$ to 5 moles, especially $1\times10^{-2}$ to 1 mole per mole of silver halide.

As a binder in the light-sensitive material of the invention, though gelatin is advantageously used, there may also be used, if necessary, other hydrophilic colloids such as gelatin derivatives, graft polymers obtained by grafting other polymers on gelatin, proteins other than gelatin, sugar derivatives, cellulose derivatives and synthetic hydrophilic homo- or co-polymers.

The material of a reflective support relating to the invention is not particularly limited, typical examples include paper coated with polyethylene containing a white pigment, baryta paper, polyvinylchloride sheets and polypropylene or polyethylene terephthalate supports containing a white pigment. Particularly preferred are those having a surface layer made of polyolefin resin containing a white pigment.

Inorganic and/or organic white pigments can be used as the above white pigment. And inorganic white pigments are preferably used; examples thereof include sulfates of an alkaline earth metal such as barium sulfate, carbonates of an alkaline earth metal such as calcium carbonate, silicas such as finely pulverized synthetic silicates, calcium silicate, alumina, alumina hydrates, titanium oxide, zinc oxide, talc and clay. Among them, barium sulfate and titanium oxide are particularly preferred.

The amount of the white pigment contained in the surface water-resistant resin layer of a reflective support is desirably not less than 10 wt %, more desirably not less than 13 wt % and most desirably not less than 15 wt % of the surface water-resistant resin layer. The degree of dispersion of a white pigment in the surface water-resistant resin layer of a paper support can be determined by the method described in Japanese Pat. O.P.I. Pub. No. 28640/1990. When measurement is made by use of this method, the degree of dispersion of a white pigment, given as a coefficient of variation described in the above specification, is desirably 0.20 or less, more desirably 0.15 or less and most desirably 0.10 or less.

The light-sensitive material relating to the invention may be coated, after the support is subjected to a surface treatment such as corona discharge, ultraviolet irradiation or flame treatment if necessary, directly with a silver halide emulsion or via a subbing layer, one or more subbing layers provided to raise the adhesion on the support surface, antistatic property, dimensional stability, abrasion resistance, hardness, antihalation property, frictional property and/or other properties.

In coating a silver halide emulsion, a thickener may be added to the emulsion for the improvement of coatability. Extrusion coating and curtain coating, each of which allows a simultaneous coating of two or more layers, are particularly useful as a method for coating.

As aromatic primary amine type developing agents, the conventional compounds can be used; the following are examples of such compounds:

CD-1 N,N-diethyl-p-phenylenediamine
CD-2 2-amino-5-diethylaminotoluene
CD-3 2-amino-5-(N-ethyl-N-laurylamino)toluene
CD-4 4-N-ethyl-N-(β-hydroxyethylamino)aniline
CD-5 2-methyl-4-N-ethyl-N-(β-hydroxyethylamino)aniline
CD-6 4-amino-3-methyl-N-ethyl-N-(β-methanesulfonamidoethyl) aniline
CD-7 N-(2-amino-5-diethylaminophenylethyl)methanesulfonamide
CD-8 N,N-dimethyl-p-phenylenediamine
CD-9 4-amino-3-methyl-N-ethyl-N-methoxyethylaniline
CD-10 4-amino-3-methyl-N-ethyl-N-(β-ethoxyethyl-)aniline
CD-11 4-amino-3-methyl-N-ethyl-N-(β-butoxyethyl-)aniline In the process for forming images according to the invention, the compound represented by the following formula CD-I is preferably employed for the purpose of shortening the developing time:

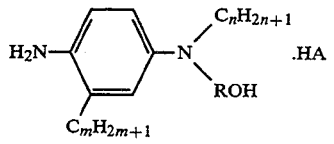

Formula CD-I

In the formula, R represents a straight-chain or branched alkylene group having 3 carbon atoms; m and n each represent an integer of 1 to 4; and HA represents an inorganic or organic acid, examples of which include hydrochloric acid, sulfuric acid, nitric acid and p-toluenesulfonic acid.

These color developing agents can be readily synthesized by the method described in Journal of American Chemical Society, Vol. 73, 3100 (1951).

The following are typical examples of the compound represented by Formula CD-I:

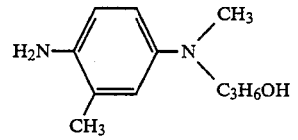

(I-1)

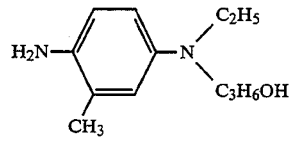

(I-2)

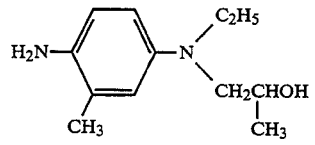

(I-3)

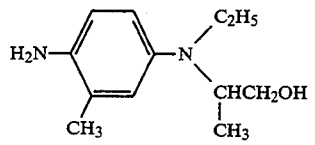

(I-4)

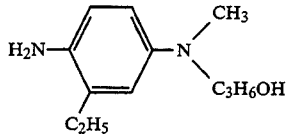

(I-5)

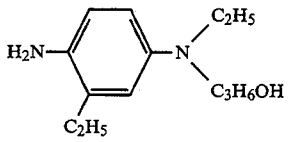

(I-6)

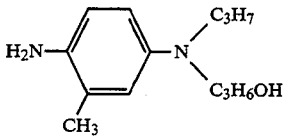

(I-7)

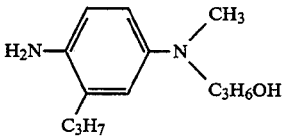

(I-8)

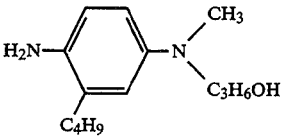

(I-9)

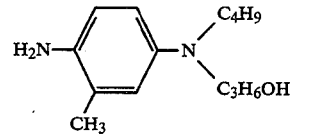

(I-10)

The above color developing agents are used in an amount of usually $1\times10^{-2}$ to $2\times10^{-1}$ mole per liter of color developer; but, in view of rapid processing, it is preferable to use them in an amount of $1.5\times10^{-2}$ to $2\times10^{-1}$ mole per liter. These color developing agents may be used singly or in combination with other conventional p-phenylenediamine derivatives. In the invention, compounds preferably combined with the compound represented by Formula CD-I are those previously denoted by CD-5, CD-6 and C-9.

These p-phenylenediamine derivatives are generally used in the form of salts, such as sulfates, hydrochlorides, sulfites, nitrates and p-toluenesulfonates.

Besides the above components, the color developer according to the invention may contain the following developing components. For example, there may be used singly or in combination alkali agents, such as sodium hydroxide, potassium hydroxide, sodium metaborate, potassium metaborate, trisodium phosphate, tripotassium phosphate, borax and silicates, within the limits not to causing precipitation and maintaining a pH stabilizing effect. Further, for developer preparation reasons or for the purpose of enhancing the ionic strength, there may be used a variety of salts such as disodium hydrogenphosphate, dipotassium hydrogenphosphate, sodium hydrogencarbonate, potassium hydrogencarbonate and borates.

If necessary, inorganic or organic antifoggants may be added. For the purpose of development control, halide ions are usually used. In the invention, chloride ions, e.g., potassium chloride and sodium chloride, are mainly used from the need to complete development in a short time. The amount of chloride ions is roughly $3.0\times10^{-2}$ mole or more, preferably $4.0\times10^{-2}$ to $5.0\times10^{-1}$ mole per liter of color developer. Bromide ions may also be used within the limits not harmful to the effects of the invention; but, because of their powerful development controlling effect, the amount of bromide ions is not more than $1.0\times10^{-3}$ mole, preferably $5.0\times10^{-4}$ mole per liter of color developer.

Further, development accelerators may also be used if necessary. Suitable development accelerators include a large number of pyridinium compounds represented by those disclosed in U.S. Pat. Nos. 2,648,604, 3,671,247, Japanese Pat. Exam. Pub. No. 9503/1969 and other cationic compounds; cationic dyestuffs such as phenosafranine; neutral salts such as thallium nitrate; polyethylene glycols and derivatives thereof disclosed in U.S. Pat. Nos. 2,533,990, 2,531,832, 2,950,970, 2,577,127, Japanese Pat. Exam. Pub. No. 9504/1969; nonionic compounds such as polythioethers; organic solvents and organic amines such as ethanolamine, ethylenediamine, diethanolamine and triethanolamine, each disclosed in Japanese Pat. Exam. Pub. No. 9509/1969. In addition, there may also be used phenethyl alcohol as disclosed in U.S. Pat. No. 2,304,925, and other compounds such as acetylene glycol, methyl ethyl ketone, cyclohexanone, pyridine, ammonia, hydrazine, thioethers and amines.

Furthermore, if necessary as the color developer relating to the invention organic solvents such as ethylene glycol, methyl cellosolve, methanol, acetone, dimethylformamide, $\beta$-cyclodextrin or the compounds disclosed in Japanese Pat. Exam. Pub. Nos. 33378/1972, 9509/1969 can be used, to raise the solubility of a developing agent.

Auxiliary developers may also be used jointly with the developing agent. For example, N-methyl-p-aminophenol sulfate, phenidone, N,N'-diethyl-p-aminophenol hydrochloride and N,N,N',N'-tetramethyl-p-phenylenediamine hydrochloride are known as such auxiliary developers are usually used in an addition amount of 0.01 to 1.0 gram per liter of developer.

To prepare the above color developer, each component of the color developer is sequentially added into a prescribed amount of water with stirring. In the case of a component less soluble in water, it may be first mixed with one of the above organic solvents, such as triethanolamine, and added into water. In a more practical procedure, a plurality of components which can stably coexist are made into a concentrated mixed solution, or a mixed solid state, in a small container and then added into water to prepare the color developer.

In the invention, the above color developer may be used in an arbitrary pH range; but, in view of rapid processing, the pH is preferably in the range of 9.5 to 13.0, especially in the range of 9.8 to 12.0.

The temperature of color developing is preferably 35° C. to 70° C. The processing time can be shortened as the temperature becomes higher, but too high a temperature jeopardizes the stability of a processing solution. Accordingly, development at a temperature of 37° C. to 60° C. is particularly preferred.

The conventional method of color developing is usually carried out in about 3 minutes and 30 seconds, but color developing according to the invention is carried out within 25 seconds. Preferably, it is performed within the range of 3 to 20 seconds.

The replenishing amount of a color developer is 20 to 150 ml, preferably 20 to 120 ml and especially 20 to 100 ml per square meter of light-sensitive material.

The processing of the light-sensitive material substantially comprises the processes of color developing, bleach-fixing and washing including stabilizing as a substitute for washing, but there may be made addition of another process or replacement of a process with one having the same meaning, within the limits not harmful to the effect of the invention. For example, bleach-fixing can be divided into bleaching and fixing, or bleaching can be performed before bleach-fixing. In the process of forming images according to the invention, it is preferable to carry out bleach-fixing immediately after color developing.

In the invention, the bleach used in the bleach-fixing process is not limitative, but it is preferably a metal complex salt of an organic acid. Such a complex salt is formed by coordination of an organic acid such as a polycarboxylic acid, an aminopolycarboxylic acid, oxalic acid or citric acid with a metal ion such as iron, cobalt or copper ions. Preferred examples of such a complex-salt-forming organic acid are polycarboxylic acids and aminopolycarboxylic acids. These polycarboxylic acids and aminopolycarboxylic acids may be alkali metal salts, ammonium salts or water-soluble amine salts.

Typical examples of these metal complex salts of an organic acid include the compounds [2] to [20] exemplified on pages 58–59 of Japanese Pat. O.P.I. Pub. No. 205262/1989.

These bleaching agents are used in an amount of 5 to 450 grams, preferably 20 to 250 grams per liter of bleach-fixer. Besides such bleaching agents, the bleach-fixer contains a silver halide fixing agent and, if necessary, there may be used a bleach-fixer containing a sulfite as a preservative. In addition, there may also be used a bleach-fixer containing a large amount of a halide such as ammonium bromide besides an ethylenediaminetetracetic acid ferric complex salt bleach and a silver halide fixing agent, or a special bleach-fixer in which an ethylenediaminetetracetic acid ferric complex salt bleach and a large amount of a halide such as ammonium bromide are combined. Usable halides other than ammonium bromide are hydrochloric acid, hydrobromic acid, lithium bromide, sodium bromide, potassium bromide, sodium iodide, potassium iodide and ammonium iodide.

The silver halide fixing agent contained in the bleach-fixer is a compound which undergoes reaction with silver halide to form a water-soluble complex salt when used in the usual fixing process. Typical examples of the compound include thiosulfates such as potassium thiosulfate, sodium thiosulfate, ammonium thiosulfate; thiocyanates such as potassium thiocyanate, sodium thiocyanate, ammonium thiocyanate; thiourea and thioether. These fixing agents may be used at a concentration of more than 5 grams per liter of bleach-fixer up to a saturation point, but these are generally used at a concentration of 70 to 250 g/l.

The bleach-fixer may contain, singly or in combination of two or more kinds, various pH buffers such as boric acid, borax, sodium hydroxide, potassium hydroxide, sodium carbonate, potassium carbonate, sodium hydrogencarbonate, potassium hydrogencarbonate, acetic acid, sodium acetate and ammonium hydroxide. Further, it may contain a variety of optical whitening agents, defoamers and surfactants. Furthermore, there may also be contained preservatives such as hydrogensulfite adducts of hydroxylamine, hydrazine and aldehyde compounds; organic chelating agents such as aminopolycarboxylic acids; stabilizers such as nitroalcohols, nitrates; and organic solvents such as methanol, dimethylformamide, dimethylsulfoxide.

The bleach-fixer relating to the invention may further contain various bleaching accelerators disclosed in Japanese Pat. O.P.I. Pub. Nos. 280/1971, 42349/1974, 71634/1979, Japanese Pat. Exam. Pub. Nos. 8506/1970, 8836/1970, 556/1971, 9854/1978 and Belgian Pat. No. 770,910.

The bleach-fixer is used at a pH not less than 4.0. Practically, it is used in a pH range of 4.0 to 9.5, preferably 4.5 to 8.5 and especially in a pH range of 5.0 to 8.5.

The bleach-fixing is carried out at a temperature not higher than 80° C.; preferably, it is carried out at a temperature not higher than 55° C. in order to prevent evaporation. The bleach-fixing time is preferably 3 to 45 seconds, especially 5 to 30 seconds.

In the photographic processing according to the invention, washing is carried out after the above color developing and bleach-fixing. Preferred procedures for such washing are hereinafter described.

In a washing liquid, a chelating agent and an ammonium compound are preferably contained.

It is preferable that the washing liquid contain a sulfite within a range not to allow bacteria to propagate.

Preferably, the washing liquid used in the invention contains a fungicide to prevent precipitation of sulfur or sulfides and improve image preservability.

The washing liquid according to the invention preferably contains a metal compound in conjunction with a chelating agent.

Besides the above compounds, the washing liquid may contain a compound having an aldehyde group.

In the invention, deionized water treated with an ion exchange resin may be employed as a washing liquid.

The pH of the washing liquid used in the invention is within a range of 5.5 to 10.0. As a pH adjustor, any of the conventional alkali agents and acid agents can be used in the invention.

The washing is carried out in a temperature range of preferably 15° C. to 60° C., especially 20° C. to 45° C. The washing time is preferably 5 to 60 seconds and especially 5 to 50 seconds. When a plurality of tanks are used in the washing process, it is preferable that the processing in a front tank be carried out in a short time and the processing in a rear tank in a long time. In a particularly preferred mode, the processing is sequentially carried out with a processing time in a rear tank longer than that in the preceding tank by 20 to 50%.

When the washing liquid is fed in a multi-tank countercurrent mode, the liquid is fed to a rear bath and overflown into the preceding tank. Of course, the processing may also be carried out by use of a single tank. In adding the above compounds to the washing tank, various methods can be used: in one method, these compounds are added in the form of concentrated solutions directly to the washing tank; in another method, these compounds are added together with other additives to a washing liquid to be fed to the washing tank, and the resulting solution is used as a washing replenisher.

In the washing process, the volume of the washing liquid used per unit area of light-sensitive material is preferably 0.1 to 50 times, especially 0.5 to 30 times the volume of a liquid brought from the preceding bath, usually, a bleach-fixer or a fixer. The number of washing tanks employed in the washing process is preferably 1 to 5, especially 1 to 3.

The developing, bleach-fixing and washing processes are performed for a time not more than 2 minutes in total. The total time for the developing, bleach-fixing and washing is preferably 6 to 90 seconds, more preferably 9 to 60 seconds.

The processing apparatus used in the process of forming images according to the invention may be any of the conventional apparatus. To be concrete, there may be employed a roller transport type in which a light-sensitive material is conveyed while itself being sandwiched between rollers arranged in a processing tank; an endless belt type in which a light-sensitive material is fixed on a belt and conveyed; a slit tank type in which a processing tank is made in the shape of a slit, and a light-sensitive material is conveyed into this processing tank while a processing solution is fed therein; a spray type in which a processing solution is sprayed; a web type in which a light-sensitive material is brought into contact with a carrier saturated with a processing solution; and a type which uses a viscous processing solution.

The interval of time between exposure and development is not particularly limited, but a shorter time is preferred to shorten the total processing time. The light-sensitive material according to the invention can be advantageously used in a short time processing, because it causes little change in image density even when the interval between exposure and development is less than 30 seconds, and thereby a high image quality can be obtained constantly.

EXAMPLES

EXAMPLE 1

A reflective paper support was prepared by laminating high density polyethylene on one side of paper pulp having a basis weight of 180 g/m$^2$ and, on the other side to be coated with an emulsion layer, titanium-oxide-containing high density polyethylene. The above titanium-oxide-containing polyethylene was prepared by dispersing 15 wt % surface-treated anatase-type titanium oxide in molten polyethylene.

A multilayered light-sensitive material, sample 101, was prepared by forming the layers shown in the following tables on the above reflective support. The coating solutions were prepared in the following manner.

A yellow coupler dispersion was prepared by steps of dissolving 26.7 g of yellow coupler Y-1, 10.0 g of dye image stabilizer ST-1, 6.67 g of dye image stabilizer ST-2, 0.67 g of additive HQ-1 and 6.67 g of high boiling solvent DNP in 60 ml of ethyl acetate, and then dispersing this solution in 220 ml of 10% aqueous solution of gelatin containing 9.5 ml of 15% surfactant SU-1 using a supersonic homogenizer. This dispersion was mixed with a blue-sensitive silver halide emulsion containing 8.68 g of silver to obtain a coating solution for the 1st layer. Coating solutions for the 2nd to 7th layers were also prepared likewise. Then, hardener H-1 was added to the 2nd and 4th layers, and hardener H-2 in the 7th layer. As coating aids, surfactants SU-2 and SU-3 were added to adjust the surface tension.

| Layer | Compositions | Addition Amount ($g/m^2$) |
|---|---|---|
| 7th layer (protective layer) | Gelatin | 1.00 |
| | Compound (9) of the invention | 0.002 |
| 6th layer (UV absorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistain agent (HQ-1) | 0.01 |
| | DNP | 0.20 |
| | PVP | 0.03 |
| | Anti-irradiation dye (AI-1) | 0.02 |
| 5th layer (red-sensitive layer) | Gelatin | 1.30 |
| | Red-sensitive silver chlorobromide emulsion (Em-R1) | 0.21 |
| | Cyan coupler (C-1) | 0.26 |
| | Cyan coupler (C-2) | 0.09 |

-continued

| Layer | Compositions | Addition Amount ($g/m^2$) |
|---|---|---|
| | Dye image stabilizer (ST-1) | 0.20 |
| | Antistain agent (HQ-1) | 0.01 |
| | HBS-1 | 0.20 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistain agent (HQ-1) | 0.03 |
| | DNP | 0.40 |
| | Anti-irradiation dye (AI-2) | 0.01 |
| 3rd layer (green-sensitive layer) | Gelatin | 1.40 |
| | Green-sensitive silver chlorobromide emulsion (Em-G1) | 0.17 |
| | Magenta coupler (M-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| 2nd layer (intermediate layer) | Gelatin | 1.20 |
| | Antistain agent (HQ-2) | 0.12 |
| | DIDP | 0.15 |
| | Compound (9) of the invention | 0.002 |
| | Anti-irradiation dye (AI-3) | 0.01 |
| 1st layer (blue-sensitive layer | Gelatin | 1.20 |
| | Blue-sensitive silver chlorobromide emulsion (Em-B1) | 0.26 |
| | Yellow coupler (Y-X) | 0.80 |
| | Dye image stabilizer (ST-1) | 0.30 |
| | Dye image stabilizer (ST-2) | 0.20 |
| | Antistain agent (HQ-1) | 0.02 |
| | DNP | 0.20 |
| Support | Polyethylene laminated paper | |

The amount of silver halide is given in an amount of silver present.

Additives used in sample preparation were as follows:

| | |
|---|---|
| HQ-1 | 2,5-di-t-octylhydroquinone |
| HQ-2 | 2-hexadecyl-5-methylhydroquinone |
| HBS-1 | 1-dodecyl-4-p-toluenesulfonamidobenzene |
| DOP | dioctyl phthalate |
| DNP | dinonyl phthalate |
| DIDP | di-i-decyl phthalate |
| PVP | polyvinylpyrrolidone |
| SU-1 | sodium tri-i-propylnaphthalenesulfonate |
| SU-2 | sodium di(2-ethylhexyl)sulfosuccinate |
| SU-3 | sodium di(2,2,3,3,4,4,5,5-octafluoropentyl)sulfosuccinate |
| H-1 | sodium 2,4-dichloro-6-hydroxy-s-triazine |
| H-2 | tetrakis(vinylsulfonylmethyl)methane |

Y-X

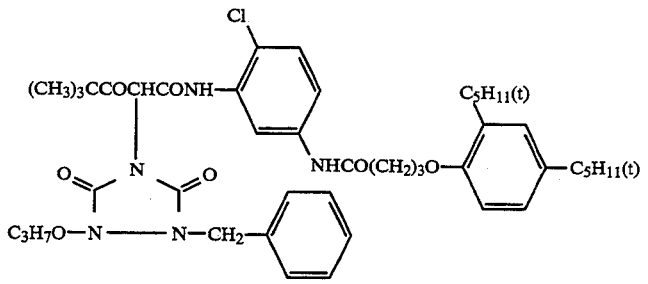

-continued
M-1
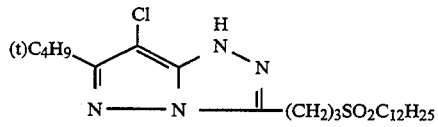
C-1
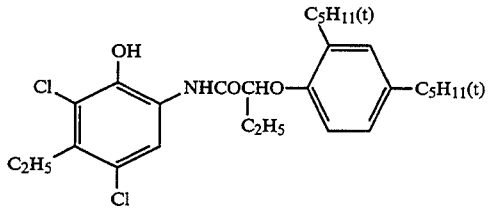
C-2
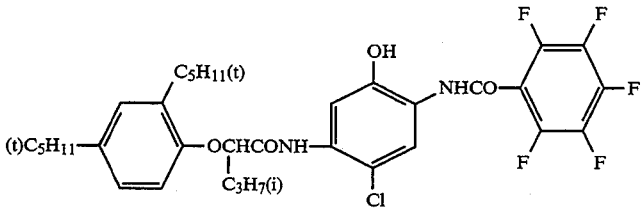
ST-1
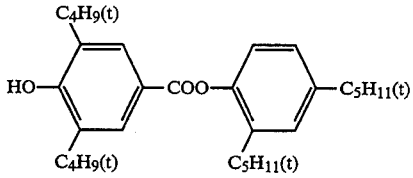
ST-2
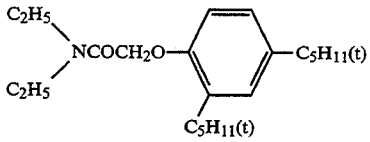
ST-3
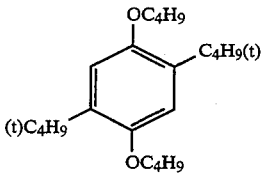
ST-4
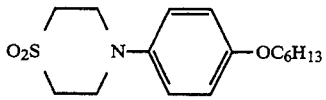
ST-5
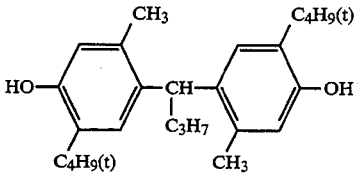
UV-1
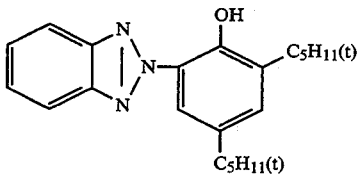

-continued

F-1

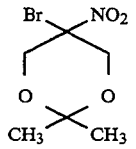

UV-2

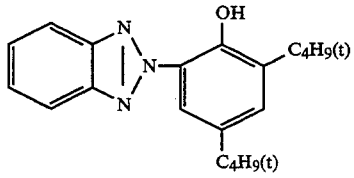

UV-3

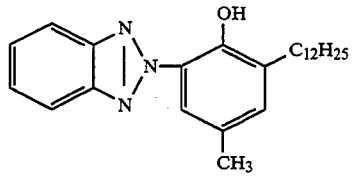

AI-1

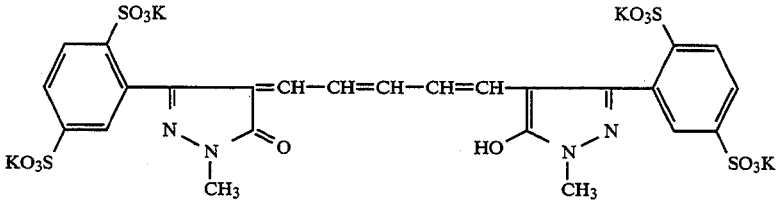

AI-2

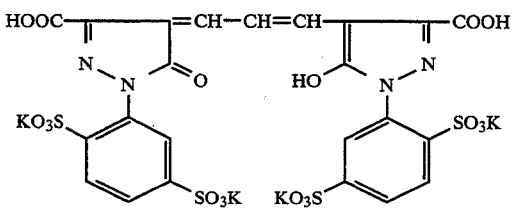

AI-3

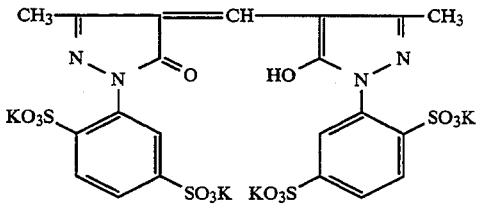

Preparation of Blue-sensitive Silver Halide Emulsion

To 1000 ml of 2% aqueous solution of gelatin kept at 40° C. were simultaneously added the following solutions (A) and (B) over a period of 30 minutes, while keeping the pAg at 6.5 and the pH at 3.0. Then, the following solutions (C) and (D) were simultaneously added thereto over a period of 180 minutes while keeping the pAg at 7.3 and the pH at 5.5. During the addition, the pAg was controlled by the method described in Japanese Pat. O.P.I. Pub. No. 45437/1984, and the pH was controlled by use of sulfuric acid or an aqueous solution of sodium hydroxide.

| | |
|---|---|
| Solution (A) | |
| Sodium chloride | 3.42 g |
| Potassium bromide | 0.07 g |
| Water was added to make | 200 ml |
| Solution (B) | |
| Silver nitrate | 10 g |

-continued

| | |
|---|---|
| Water was added to make | 200 ml |
| Solution (C) | |
| Sodium chloride | 102.7 g |
| Potassium bromide | 2.10 g |
| Water was added to make | 600 ml |
| Solution (D) | |
| Silver nitrate | 300 g |
| Water was added to make | 600 ml |

After the addition, the resulting silver halide grains were subjected to desalting using a 5% aqueous solution of Demol N made by Kao Atlas Co. and a 20% aqueous solution of magnesium sulfate, then these were mixed with an aqueous solution of gelatin. Emulsion EMP-1 so obtained comprised monodispersed cubic grains having an average grain size of 0.85 μm, a coefficient of variation S/R of 0.07 and a silver chloride content of 99.0 mol %.

A blue-sensitive silver halide emulsion (Em-B1) was obtained by subjecting emulsion EMP-1 to chemical ripening for 90 minutes at 50° C. using the following compounds:

| | |
|---|---|
| Sodium thiosulfate | 0.8 mg/mol AgX |
| Chloroauric acid | 0.5 mg/mol AgX |
| Stabilizer (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

Preparation of Green-sensitive Silver Halide Emulsion

Emulsion EMP-2 comprising monodispersed cubic grains having an average grain size of 0.43 μm, a coefficient of variation S/R of 0.07 and a silver chloride content of 99.0 mol % was prepared in the same manner as EMP-1, except that the addition time of solutions (A) and (B) as well as that of solutions (C) and (D) were changed.

A green-sensitive silver halide emulsion (Era-G1) was obtained by subjecting emulsion EMP-2 to chemical ripening for 120 minutes at 55° C. using the following compounds:

| | |
|---|---|
| Sodium thiosulfate | 1.5 mg/mol AgX |
| Chloroauric acid | 1.0 mg/mol AgX |
| Stabilizer (STAB-1) | $6 \times 10^{-4}$ mol/mol AgX |
| Sensitizing dye (GS-1) | $4 \times 10^{-4}$ mol/mol AgX |

Preparation of Red-sensitive Silver Halide Emulsion

Emulsion EMP-3 comprising monodispersed cubic grains having an average grain size of 0.50 μm, a coefficient of variation S/R of 0.08 and a silver chloride content of 99.0 mol % was prepared in the same manner as EMP-1, except that the addition time of solutions (A) and (B) as well as that of solutions (C) and (D) were changed.

A red-sensitive silver halide emulsion (Em-R1) was obtained by subjecting emulsion EMP-3 to chemical ripening for minutes at 60° C. using the following compounds:

| | |
|---|---|
| Sodium thiosulfate | 1.8 mg/mol AgX |
| Chloroauric acid | 2.0 mg/mol AgX |
| Stabilizer (STAB-1) | $6 \times 10^{-4}$ mol/mol AgX |
| Sensitizing dye (RS-1) | $1 \times 10^{-4}$ mol/mol AgX |

BS-1

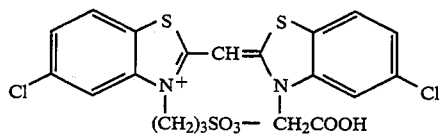

BS-2

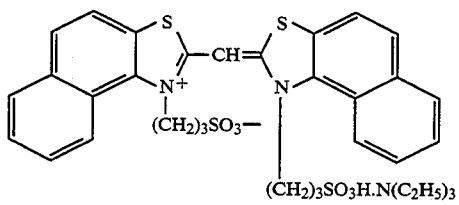

GS-1

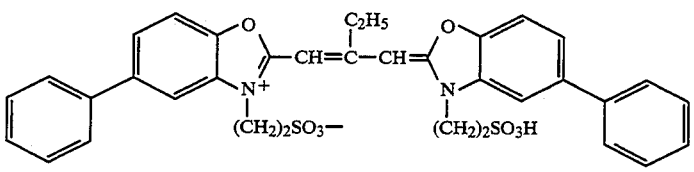

RS-1

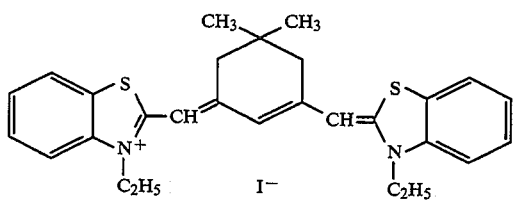

To obtain a print, each sample was subjected to exposure in the usual manner and then to continuous processing according to the following process A or B until the replenishment amounted to 3 times the tank volume of the color developer.

| Process | Processing Temperature | Processing Time | Replenishing Rate |
|---|---|---|---|
| | Process A | | |
| Color developing A | 38.0 ± 0.3° C. | 20 sec | 80 ml/m² |
| Bleach-fixing A | 35.0 ± 0.5° C. | 20 sec | 120 ml/m² |
| Washing A | 30 to 34° C. | 60 sec | 150 ml/m² |
| Drying | 30 to 80° C. | 30 sec | |
| | Process B | | |
| Color developing B | 35.0 ± 0.3° C. | 45 sec | 162 ml/m² |
| Bleach-fixing B | 35.0 ± 0.5° C. | 45 sec | 216 ml/m² |
| Washing B | 30 to 34° C. | 90 sec | 248 ml/m² |
| Drying | 60 to 80° C. | 60 sec | |

The composition of each processing solution was as follows:

| Color developer A tank solution | |
|---|---|
| Water | 800 ml |
| Triethylenediamine | 2 g |
| Diethylene glycol | 10 g |
| Potassium bromide | 0.01 g |
| Potassium chloride | 3.5 g |
| Potassium sulfite | 0.25 g |
| N-Ethyl-N-(β-methanesulfonamidoethyl)-3-methyl-4-aminoaniline sulfate | 6.0 g |
| N,N-Diethylhydroxylamine | 6.8 g |
| Triethanolamine | 10.0 g |
| Sodium diethylenetriaminepentacetate | 2.0 g |
| Optical whitening agent (4,4'-diaminostilbene-disulfonic acid derivative) | 2.0 g |
| Potassium carbonate | 30 g |

Water is added to make 1000 ml, then the pH is adjusted to 10.10.

| Color developer A replenisher | |
|---|---|
| Water | 800 ml |
| Triethylenediamine | 3 g |
| Diethylene glycol | 10 g |
| Potassium sulfite | 0.5 g |
| N-Ethyl-N-(β-methanesulfonamidoethyl)-3-methyl-4-aminoaniline sulfate | 10.0 g |
| N,N-Diethylhydroxylamine | 6.0 g |
| Triethanolamine | 10.0 g |
| Sodium diethylenetriaminepentacetate | 2.0 g |
| Optical whitening agent (4,4'-diaminostilbene-disulfonic acid derivative) | 2.5 g |
| Potassium carbonate | 30 g |

Water is added to make 1000 ml, then the pH is adjusted to 10.60.

| Color developer B tank solution | |
|---|---|
| Water | 800 ml |
| Triethanolamine | 10 g |
| N,N-Diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetracetic acid | 1.0 g |
| Disodium catechol-3,5-disulfonate | 1.0 g |
| N-Ethyl-N-(β-methanesulfonamidoethyl)-3-methyl-4-aminoaniline sulfonate | 4.5 g |
| Optical whitening agent (4,4'-diaminostilbene-disulfonic acid derivative) | 1.0 g |
| Potassium carbonate | 27 g |

Water is added to make 1000 ml, and the pH is adjusted to 10.60.

| Color developer B replenisher | |
|---|---|
| Water | 800 ml |
| Triethanolamine | 10 g |
| N,N-Diethylhydroxylamine | 5 g |
| Potassium sulfite | 0.4 g |
| 1-Hydroxyethylidene-1,1-diphosphonic acid | 1.0 g |
| Ethylenediaminetetracetic acid | 1.0 g |
| Disodium catechol-3,5-disulfonate | 1.0 g |
| N-Ethyl-N-(β-methanesulfonamidoethyl)-3-methyl-4-aminoaniline sulfonate | 8.0 g |
| Optical whitening agent (4,4'-diaminostilbene-disulfonic acid derivative) | 1.3 g |
| Potassium carbonate | 30 g |

Water is added to make 1000 ml, and the pH is adjusted to 10.60.

| Bleach-fixer A tank solution and replenisher | |
|---|---|
| Ammonium ferric diethylenetriaminepentacetate dihydrate | 65 g |
| Diethylenetriaminepentacetic acid | 3 g |
| Ammonium thiosulfate (70% aqueous solution) | 100 ml |
| 5-Amino-1,3,4-thiadiazole-2-thiol | 2.0 g |
| Ammonium sulfite (40% aqueous solution) | 27.5 ml |

Water is added to make 1000 ml, and the pH is adjusted to 6.5 with potassium carbonate or glacial acetic acid.

| Bleach-fixer B tank solution and replenisher | |
|---|---|
| Ammonium ferric ethylenediaminetetracetate dihydrate | 60 g |
| Ethylenediaminetetracetic acid | 3 g |
| Ammonium thiosulfate (70% aqueous solution) | 100 ml |
| Ammonium sulfite (40% aqueous solution) | 27.5 ml |

Water is added to make 1000 ml, and the pH is adjusted to 5.7 with potassium carbonate or glacial acetic acid.

| Washing liquid A tank solution and replenisher | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Optical whitening agent (Tinopal SFP) | 2.0 g |
| 1-Hydroxyethylidene-1,1-diphosphonic acid | 1.8 g |
| Bismuth chloride (45% aqueous solution) | 0.65 g |
| Magnesium sulfate heptahydrate | 0.2 g |
| PVP (polyvinylpyrrolidone) | 1.0 g |
| Aqueous ammonia ($NH_4OH$ 25% aqueous solution) | 2.5 g |
| Trisodium nitriletriacetate | 1.5 g |

Water is added to make 1000 ml, and the pH is adjusted to 7.5 with sulfuric acid or aqueous ammonia.

| Washing liquid B tank solution and replenisher | |
|---|---|
| 5-Chloro-2-methyl-4-isothiazoline-3-one | 1.0 g |
| Ethylene glycol | 1.0 g |
| 1-Hydroxyethylidene-1,1-diphosphonic acid | 2.0 g |
| Ethylenediaminetetracetic acid | 1.0 g |
| Ammonium hydroxide (20% aqueous solution) | 3.0 g |
| Optical whitening agent (4,4'-diaminostilbene-disulfonic acid derivative) | 1.5 g |

Water is added to make 1000 ml, and the pH is adjusted to 7.0 with sulfuric acid or potassium hydroxide.

Ten sheets of each printed sample, each pasted on a mount with a stick paste Pit Great made by Tombow Co., were laid one over another and stored for 3 days under conditions of 60° C. and 80% RH, then visually checked for discoloration and blur of the image using the following criteria.

| | |
|---|---|
| | Discoloration |
| A | no discoloring |
| B | slight discoloring, acceptable for practical use |
| C | discoloring, unacceptable for practical use |
| | Blur |
| A | no discoloring |
| B | slight discoloring, acceptable for practical use |
| C | discoloring, unacceptable for practical use |

Besides the above samples, Samples 102–120 were prepared in the same manner as in Sample 101 except that Yellow coupler Y-X and Compound 9 were replaced by the couplers and the compounds listed in Table 1, respectively. These were processed and evaluated likewise, the results obtained are shown in Table 1.

Molecular weights of the compounds of the invention and the comparative yellow couplers used in the evaluation are shown in parentheses.

Y-1 (712), Y-2 (691), Y-3 (797), Y-5 (656), Y-6 (678), Y-9 (704), Y-10 (753), Y-11 (616), Y-13 (628), Y-15 (706), Y-19 (779), Y-20 (622), Y-X (812).

TABLE 1

| Sample No. | Yellow Coupler | Compound of the Invention & Comparative compound | Process | Discoloration | Blur |
|---|---|---|---|---|---|
| 101 (comparison) | Y-X | 9 | A | C | C |
| 102 (comparison) | Y-2 | F-1 | A | C | C |
| 103 (comparison) | Y-2 | 9 | B | C | C |
| 104 (invention) | Y-2 | 9 | A | A | A |
| 105 (invention) | Y-3 | 9 | A | B | B |
| 106 (invention) | Y-5 | 9 | A | A | A |
| 107 (invention) | Y-6 | 9 | A | A | A |
| 108 (invention) | Y-19 | 9 | A | B | B |
| 109 (invention) | Y-11 | 25 | A | B | B |
| 110 (invention) | Y-15 | 25 | A | B | B |
| 111 (invention) | Y-2 | 6 | A | B | B |
| 112 (invention) | Y-2 | 11 | A | A | A |
| 113 (invention) | Y-2 | 17 | A | A | A |
| 114 (invention) | Y-2 | 31 | A | B | B |
| 115 (invention) | Y-2 | 35 | A | B | B |
| 116 (invention) | Y-13 | 9 | A | A | A |
| 117 (invention) | Y-20 | 11 | A | A | A |
| 118 (invention) | Y-1 | 26 | A | B | B |
| 119 (invention) | Y-10 | 8 | A | B | B |
| 120 (invention) | Y-9 | 32 | A | B | B |

As is apparent from the results in Table 1, samples 104 to 120 of the invention were better than the comparative samples in image preservability even when subjected to rapid and low-replenishing continuous processing. Further, it is found that the yellow couplers of the invention and the compounds of the invention represented by Formula II each having a low molecular weight were particularly effective.

EXAMPLE 2

Color developers were prepared in the same manner as in Example 1, except that the developing agent used in Example 1, N-ethyl-N-(β-methanesulfonamidoethyl)-3-methyl-4-aminoaniline sulfate (exemplified compound CD-6), was replaced by equivalent amounts of exemplified compounds CD-2, CD-5, CD-9 and a 50/50 mixture of CD-2 and CD-6. Processing and evaluation were conducted in the same manner as in Example 1. The effects of the invention were satisfactorily brought out by all of the color developers.

What is claimed is:

1. A method of forming a color image comprising steps of imagewise exposing to light a silver halide color photographic light-sensitive material which comprises a support having thereon a silver halide emulsion layer, developing said exposed light-sensitive material with a color developer, bleach-fixing said developed light-sensitive material with a bleach-fixer, and washing said bleach-fixed light-sensitive material, wherein said silver halide emulsion layer contains a yellow coupler having a molecular weight of not more than 800 and represented by Formula Y-1 and a compound represented by Formula I, II, III or IV; said developing step is carried out for not more than 25 seconds, and said color developer is replenished with a developer replenisher in a ratio of from 20 ml to 150 ml per square meter of light-sensitive material developed by said developer; and the total time of said developing step, bleach-fixing step and washing step is not more than 2 minutes;

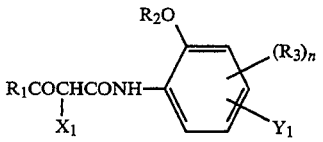

(Y-1)

wherein $R_1$ is alkyl, cycloalkyl, or aryl; $R_2$ is alkyl, cycloalkyl, acyl, or aryl; $R_3$ is a substituent; $Y_1$ is an organic group; $X_1$ is a split off group and n is 0 or 1;

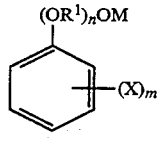

(I)

wherein $R^1$ is an alkylene group having 1 to 5 carbon atoms; M is hydrogen, alkali metal, or alkyl; X is halogen, alkyl, cycloalkyl, aryl, carboxyl, amino, hydroxyl, sulfo, nitro, alkoxycarbonyl; m is an integer of 1 to 5 and n is 0 or 1;

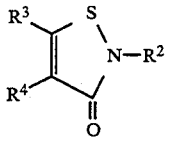

(II)

wherein $R^2$ is hydrogen, alkyl, cycloalkyl, heterocyclic, alkenyl, aralkyl, aryl, alkoxyl, —CONHR, where R is selected from the group consisting of hydrogen, alkyl, aryl, alkylthio, arylthio, alkylsulfonyl, and arylsulfonyl; $R^3$ and $R^4$ are each hydrogen, halogen, alkyl, cycloalkyl, aryl, heterocyclic, cyano, alkylthio, arylthio, alkylsulfoxide, alkylsulfonyl or alkylsulfinyl, $R^3$ and $R^4$ may be linked with each other to form a benzene ring which may have a substituent;

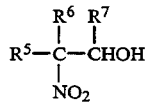

(III)

wherein $R^5$ and $R^6$ are each hydrogen, halogen, alkyl, having 1 to 5 carbon atoms, or hydroxymethyl; and $R^7$ is hydrogen or alkyl having 1 to 5 carbon atoms;

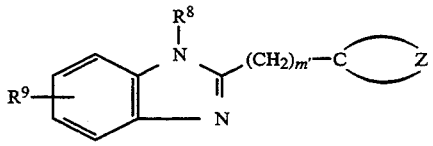

(IV)

wherein $R^8$ is hydrogen, alkyl, or aryl; $R^9$ is hydrogen, alkyl, aryl, nitro, carboxyl, sulfo, sulfamoyl, hydroxyl, halogen, alkoxy, or thiazolyl; Z is a group of atoms necessary to form a thiazole ring; and m' is 0 or 1.

2. The method of claim 1, wherein said yellow coupler is a coupler represented by Formula Y-5;

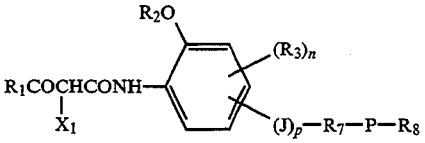

(Y-5)

wherein $R_1$, $R_2$, $R_3$, $X_1$ and n are the same as $R_1$, $R_2$, $R_3$, $X_1$ and n in Formula Y-1, respectively, J is a —N($R_5$)CO— group or a —CON($R_5$)— group, where $R_5$ is a hydrogen atom, an alkyl group, an aryl group or a heterocyclic group; p is an integer of 0 or 1; $R_7$ is an alkylene group, an arylene group, an alkylenearylene group, an arylenealkylene group or a —A—$E_1$—B— group, where A and B are each an alkylene group, an arylene group, an alkylenearylene group or an arylenealkylene group, and $E_1$ a divalent linking group; $R_8$ is an alkyl group, a cycloalkyl group, an aryl group or a heterocyclic group; and D is a linking group having a carbonyl unit or a sulfonyl unit.

3. The method of claim 1, wherein said yellow coupler is contained in said emulsion layer in an amount of from $1\times10^{-3}$ moles to 1 mole per mole of silver halide.

4. The method of claim 1, wherein said yellow coupler has a molecular weight of not more than 750.

5. The method of claim 1, wherein said compound represented by Formula I, II, III or IV is contained in said emulsion layer in an amount of from $1\times10^{-4}$ g/m$^2$ to $1\times10^{-2}$ g/m$^2$.

6. The method of claim 1, wherein said compound is a compound represented by Formula II.

7. The method of claim 1 wherein said color developer contains an aromatic primary amine color developing agent represented by Formula CD-I;

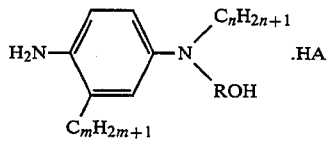

(CD-I)

wherein R is a straight or branched chain alkylene group having 3 carbon atoms; m and n are each individually an integer of 1 to 4, and Ha is an inorganic or organic acid.

8. The method of claim 6, wherein said color developer contains said color developing agent in an amount of from $1.5\times10^{-2}$ moles to $2\times10^{-1}$ moles per liter.

9. The method of claim 1, wherein said color developer contains a water soluble chloride in an amount of from $4.0\times10^{-2}$ moles to $5.0\times10^{-1}$ moles per liter.

10. The method of claim 1, wherein said color developing step is carried out for a time of 3 seconds to 20 seconds.

11. The method of claim 1, wherein said color developer is replenished with said developer replenisher in a ratio of from 20 ml to 120 ml per square meter of light-sensitive material developed said developer.

12. The method of claim 1, wherein said bleach-fixing step is carried out for a time of from 3 seconds to 45 seconds.

13. The method of claim 1, wherein said washing step is carried out for a time of from 5 second to 60 seconds.

14. The method of claim 1, wherein said total time of said steps of developing, bleach-fixing and washing is within the range of from 6 seconds to 90 seconds.

15. The method of claim 1 wherein said silver halide emulsion layer contains a yellow coupler represented by Formula Y-1, with a molecular weight of not more than 800, and a compound represented by Formula I, II, III, or IV, wherein, in Formula I, X is halogen, alkyl, cycloalkyl, carboxyl, sulfo, nitro, or alkoxycarbonyl.

16. The method of claim 1 wherein said silver halide emulsion layer contains said yellow coupler, and a compound represented by Formula II.

* * * * *